US005092607A

United States Patent [19]

Ramsay et al.

[11] Patent Number: 5,092,607

[45] Date of Patent: Mar. 3, 1992

[54] BALLISTIC IMPACT INDICATOR

[75] Inventors: J. Douglas Ramsay, 2401 W. Grand Ave., Yoakum, Tex. 77995; George D. Chappell, Desoto, Tex.

[73] Assignee: J. Douglas Ramsay, Yoakum, Tex.

[21] Appl. No.: 527,202

[22] Filed: May 22, 1990

[51] Int. Cl.[5] ..... F41J 5/06

[52] U.S. Cl. ..... 273/372

[58] Field of Search ..... 273/371-378, 273/386-389; 434/16, 19, 20, 23

[56] References Cited

U.S. PATENT DOCUMENTS

| | | | |
|---|---|---|---|
| 2,587,715 | 3/1952 | Fairchild et al. | 273/365 |
| 2,861,141 | 11/1958 | De Brocke | 200/61.46 |
| 2,926,015 | 2/1960 | Edrich | 273/372 |
| 2,934,346 | 4/1960 | Mngello | 273/372 |
| 3,272,510 | 9/1966 | Ohlund et al. | 273/372 |
| 4,361,330 | 11/1982 | Scharer | 273/372 |
| 4,514,621 | 4/1985 | Knight et al. | 273/372 |
| 4,656,397 | 4/1987 | Chappell et al. | 315/241 |
| 4,865,329 | 9/1989 | Geuss | 273/372 |

FOREIGN PATENT DOCUMENTS

| | | | |
|---|---|---|---|
| 2744415 | 4/1979 | Fed. Rep. of Germany | 273/404 |
| 365637 | 11/1962 | Switzerland | 273/372 |
| 594227 | 12/1977 | Switzerland | 273/372 |
| 663840 | 1/1988 | Switzerland | 273/403 |

*Primary Examiner*—Benjamin Layno
*Attorney, Agent, or Firm*—Cahill, Sutton & Thomas

[57] ABSTRACT

A ballistic impact indicator, for alerting a marksman that a bullet has struck a target, includes a vibration sensor mounted to an adjustable clamp for removably securing the vibration sensor to target board. The vibration sensor is electrically coupled by a connector cable to a controller circuit for operating a xenon flash tube strobe light. In response to a detection of an impact by the vibration sensor, the controller circuit generates a delayed trigger signal, the delay of which can be selected by the user between approximately 2 and 6 seconds, for triggering the strobe light. The controller circuit also causes the strobe light to flash repeatedly if either the vibration sensor or connector cable are hit by a bullet. The sensitivity of the vibration sensor is adjustable in accordance with the energy of the bullet and wind conditions. The strobe light and controller circuit are powered by a rechargeable storage battery to provide a portable unit.

18 Claims, 3 Drawing Sheets

STROBE TRIGGER
POWER ENABLE
SWITCHED POWER
OSCILLATOR
FLASH SEQUENCER
FLASH ENABLE
START
FAULT
LOW VOLT SHUTDOWN
BATTERY 12VDC
2 SEC.
COM
6 SEC.
+12V

BALLISTIC IMPACT INDICATOR

BACKGROUND OF THE INVENTION

1. Field of the Invention

The present invention relates generally to firing range targets, and more particularly, to devices used to indicate that a marksman has fired a bullet or other round of ammunition that has struck a target.

2. Description of the Prior Art

Cardboard targets are commonly used at firing ranges for training persons in the use of firearms. Such targets are also used at military and police firing ranges to allow soldiers and police officers to maintain and improve their marksmanship skills.

When the target is at a significant distance from the marksman, it is difficult for the marksman to determine whether a shot that he or she has fired has hit the target. Accordingly, an observer must either be stationed close to the target or be provided with binoculars to advise the marksman of his or her progress.

Various signalling devices are known in the art for indicating to a marksman whether a target has been hit. For example, Swiss Patent No. 594,227 discloses a firing practice target which couples an acoustic converter to the target to sense sound waves propagated within the target. An amplifier is used to amplify the signal produced by the acoustic converter for actuating an optical display when the target is hit.

Swiss Patent No. 663,840 discloses a shooting gallery target in a form of a housing having an opening covered by a target. A bullet passing through the paper target is deflected by a sheet of bullet-proof glass and strikes an electronic sensor to illuminate a light positioned behind the target.

Swiss Patent No. 365,637 discloses a target including an indicator circuit controlled by moveable switching elements under the effect of a bullet impact.

West German Patent No. 27 44 415 discloses a firing practice target having a light curtain behind a target hole. The light curtain generates a switching pulse when a bullet passes through the curtain. The firing practice target can be linked to an electronic control and display system.

U.S. Pat. No. 4,514,621 issued to Knight et al. discloses a complex, computerized firing range including transducers located adjacent the target area for detecting airborne shock waves from supersonic projectiles.

U.S. Pat. No. 2,587,715 issued to Fairchild et al. discloses an impact detection mechanism used within a target airplane for aircraft gunnery training. When a bullet hits an armor plate, light signal lamps located on the outside of the target plane are illuminated.

U.S. Pat. No. 2,926,015 issued to Edrich discloses a target device having a shock sensitive microphone mounted upon the target for transmitting a shock wave to the microphone. The signal generated by the microphone is amplified and used to operate a counting device.

U.S. Pat. No. 3,272,510 issued to Ohlund et al. discloses an apparatus for generating a simulated smoke signal for gunnery target practice. The disclosed apparatus generates a visible signal in the nature of a simulated smoke puff to indicate that a gunner has shot a target.

U.S. Pat. No. 4,361,330 issued to Scharer discloses a target for a rifle range including a mounting frame internally equipped with electroacoustic sensors to serve as an impact detecting chamber. The sensors are connected by wires to an amplifier leading to an evaluator for visually indicating the occurrence of a hit.

U.S. Pat. No. 2,861,141 issued to De Brocke discloses an impact actuated device for closing an electric circuit of a stroboscopic light based upon the impact of an action to be photographed.

While the devices disclosed in the aforementioned patents serve to provide a visual indication that a target has been hit, such devices trigger the visual indicator essentially immediately after the bullet hits the target. However, most firearms produce a recoil as a reaction to the firing of the bullet, and the recoil often causes the marksman to temporarily lose focus of the target area. Consequently, the marksman may be unable to detect activation of the visual indicator until after the visual indicator has been extinguished.

As indicated above, devices have been disclosed wherein sensors detect the impact or passage of a bullet. Occasionally, a bullet may strike the sensor or wires connecting the sensor to related circuitry. If the sensor or connecting wires are damaged by the impact of the bullet, the target device may stop functioning. However, target devices of the type disclosed above do not warn a marksman that the sensors or related wiring have been damaged.

Many different types of targets may be used at various firing ranges. Moreover, even as to a particular type of target, such targets rapidly disintegrate from repeated penetration by bullets and must be changed. However, many of the impact sensors of the type disclosed in the above-mentioned patents are either embedded within the target or are not easily removed therefrom.

Many of the target devices disclosed in the above-mentioned patents require a 110 volt alternating current power supply for proper operation. While such a power requirement may be met at a permanently based firing range without difficulty, such a requirement precludes the use of such target devices out in the field.

In addition, target devices may be used with a wide range of firearms wherein the bullets striking the target may have a wide range of energies. Further, such a target device must be capable of withstanding strong winds without falsely signaling target hits.

Accordingly, it is an object of the present invention to provide a ballistic impact indicator for alerting a marksman that a bullet fired by the marksman has hit a desired target, wherein the visual indication of impact is delayed sufficiently to permit the marksman to recover from the effects of recoil and to refocus upon the target area.

It is another object of the present invention to provide such a ballistic impact indicator wherein the sensor may be quickly and easily attached to a wide variety of commonly used target boards.

It is still another object of the present invention to provide such a ballistic impact indicator which permits the user to select the amount of delay between the striking of the target and the activation of the visual indication.

It is yet another object of the present invention to use a signaling device which can be spotted from a great distance away from the target.

A further object of the present invention is to provide such a ballistic impact indicator which is portable and which is easy to assembly and operate in the field.

A still further object of the present invention is to provide such a ballistic impact indicator which readily alerts the user when a bullet has struck and damaged either the impact sensor or the cable coupling the impact sensor to the detection circuitry.

It is still another object of the present invention to provide such a ballistic impact indicator wherein the sensitivity of the impact sensor is readily adjustable in the field to account for different types of weapons producing different bullet energies and to readily adjust for varying wind conditions to avoid false triggering due to wind gusts.

These and other objects of the present invention will become more apparent to those skilled in the art as the description thereof proceeds.

SUMMARY OF THE INVENTION

Briefly described, and in accordance with a preferred embodiment thereof, the present invention relates to a ballistic impact indicator for alerting a marksman that a bullet fired by the marksman has hit a desired target and including a vibration sensor adapted to produce an electrical impulse when a bullet strikes the target. An attachment mechanism, preferably in the form of an adjustable clamp, removably attaches the vibration sensor along an edge of the target. Preferably, the vibration sensor is itself mounted to the rear of the adjustable clamp.

The ballistic impact indicator further includes a controller circuit having an input electrically coupled with the vibration sensor by a connector cable and responsive to the electrical impulse produced by the vibration sensor for generating a delayed trigger signal in response thereto. A light, preferably in the form of a strobe flash, is coupled to the control circuit and is triggered thereby to create an intense, focused flash of light of short duration visible at a distance by the marksman. A power supply is coupled to the controller circuit and strobe flash for providing electrical power thereto.

In order to permit the ballistic impact indicator to adjust for differently powered firearms and varying wind conditions, the vibration sensor is adjustable to allow the marksman to adjust the sensitivity of the vibration sensor, and thereby adjust the degree of force which must be transmitted by the target board to the vibration sensor in order to create an electrical impulse signifying a "hit".

The controller circuit of the ballistic impact indicator delays creation of the trigger signal that actuates the strobe flash for at least one second after the vibration sensor produces the electrical impulse, thereby allowing the marksman to recover from any recoil produced by the firing of the bullet, and to refocus upon the target area before the strobe flash is triggered. The ballistic impact indicator may include a selection switch to select the period of delay for the trigger signal before the strobe flash is actuated following each "hit".

The strobe flash itself preferably utilizes a xenon flash tube for creating an intense flash of light which may be viewed up to one mile from the target area.

The power supply for the ballistic impact indicator is preferably an electrical storage battery enclosed within the same housing containing the strobe flash tube and controller circuit. Such a rechargeable storage battery allows the ballistic impact indicator to be portable and to be used in the field remote from electrical service lines.

The controller circuit of the ballistic impact indicator includes circuitry for causing the strobe flash to repeatedly flash if a bullet or other projectile damages either the vibration sensor or the connector cable coupling the vibration sensor to the controller circuit. In this manner, the marksman is alerted to the problem and can repair or replace the sensor and/or connector cable before continuing with the session.

DETAILED DESCRIPTION OF THE PREFERRED EMBODIMENT

Figure 1:
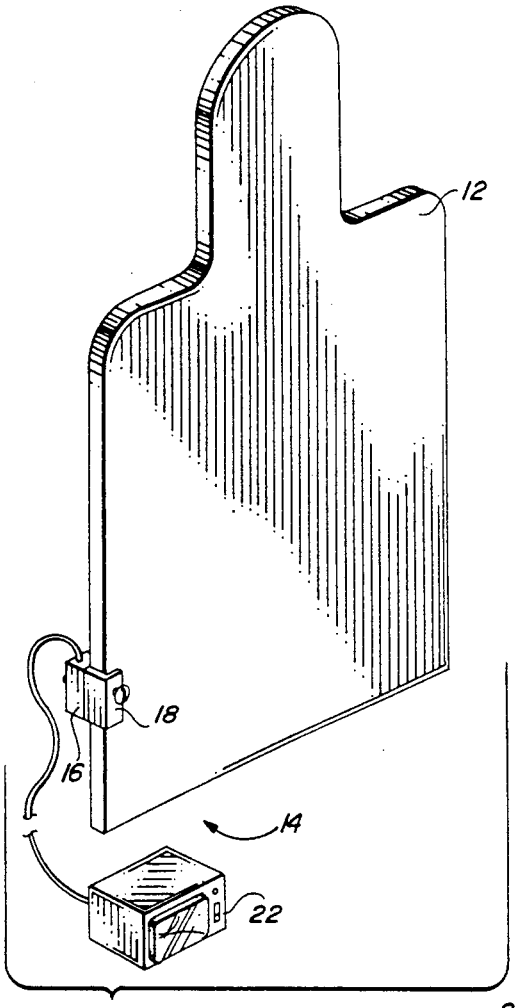
FIG. 1 is a perspective view of a conventional target board to which the ballistic impact indicator of the present invention has been attached.

In FIG. 1, a cardboard target board 12 is shown along with the ballistic impact indicator, designated generally by reference numeral 14, constructed in accordance with the present invention. Target board 12 may be made of any material rigid enough to transmit vibrations; one-eighth inch cardboard is typical. As shown in FIG. 1, ballistic impact indicator 14 includes a vibration sensor 16, an attachment bracket 18 for attaching the vibration sensor to the target board 12, a controller circuit/power supply/strobe flash housing 22 (not shown to scale), and a connector cable 20 for coupling vibration sensor 16 to the controller circuitry contained within housing 22.

Figure 2:
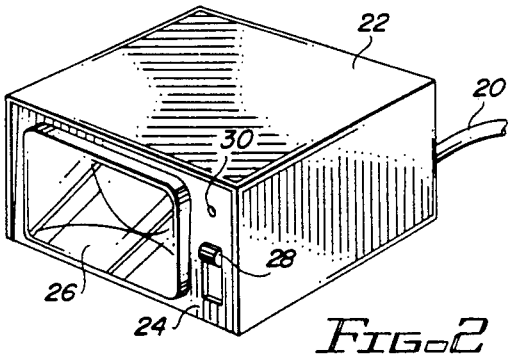
FIG. 2 is a perspective view of the housing comprising a component of the ballistic impact indicator and enclosing a xenon strobe tube, controller circuitry, and a rechargeable power supply.

The housing 22 is shown in greater detail in FIG. 2 and includes a front face 24 through which the lens of a xenon strobe flash tube 26 extends for signalling that a projectile has struck target board 12. Also visible on the front face 24 of housing 22 is a slide switch 28 as will be explained further in regard to the schematic of FIG. 7. Switch 28 may be operated by the user to vary the delay between the time that a bullet strikes target board 12 and the time that strobe flash tube 26 is triggered to flash. In the preferred embodiment of the present invention, slide switch 28 includes a first position for selecting a two second delay, as well as a second position for selecting a six second delay. Also visible on front face 24 is the lens of a light emitting diode (LED) 30 for signalling to a user that the voltage remaining across the storage battery (not shown) enclosed within housing 22 has fallen below the level required for reliable operation, thereby alerting the user that the storage battery must be recharged. In use, housing 22 may be supported on the ground provided that there is little brush or other obstacles between the marksman and target board 12. On the other hand, if brush, tall grass or other obstacles might hinder the view of strobe flash tube 26 when the marksman is in a shooting position, then housing 22 may be elevated above the ground for easier viewing.

Figure 3:
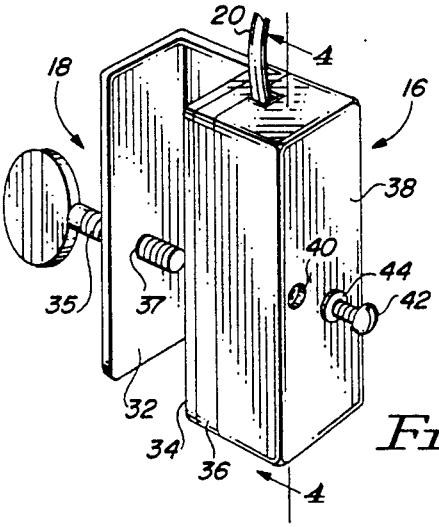
FIG. 3 is a perspective view of the vibration sensor of the present invention illustrating a sensitivity adjustment screw and an adjustable clamp used to secure the vibration sensor to the target board.

Shown in greater detail in FIG. 3., attachment bracket 18 is shown in the form of a U-shaped channel approximately one inch in width and made of metal stock. The attachment bracket 18 includes a pair of opposing side faces 32 and 34. A thumb screw threadedly engages a threaded aperture 37 formed in side wall 32. The channel of attachment bracket 18 may be fitted over the edge of target board 12, as shown in FIG. 1, and the user thereafter tightens thumb screw 35 until the end of screw 35 is tightly clamped against the front of target board 12, causing side wall 34 of attachment bracket 18 to firmly engage the rear face of target board 12.

Figure 5:
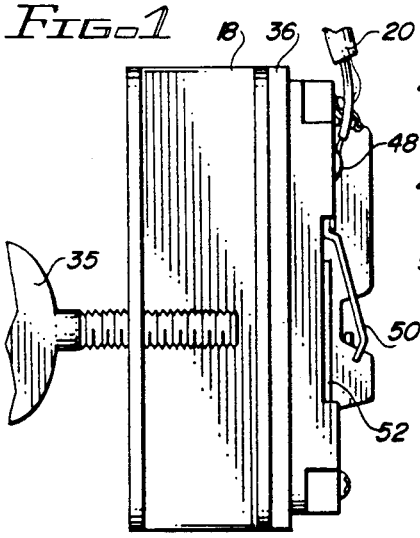
FIGS. 5 and 6 are side views of the vibration sensor and adjustable clamp with the outer cover removed.

As shown in FIG. 3, vibration sensor 16 includes a base 36 that is mounted to side wall 34 of attachment bracket 18. Base 36 of vibration sensor 16 may be conveniently mounted to side wall 34 of bracket 18 with screws, epoxy glue, or two-sided foam tape. Vibration sensor 16 further includes a cover portion 38 which normally covers the internal components of vibration sensor 16. Cover 16 is retained by retaining screw 40. Connector cable 20 protrudes from vibration sensor 16 for extending to the back of housing 22 (see FIG. 2). Still referring to FIG. 3, a slotted head adjustment screw 42 protrudes through a circular grommet 44 of vibration sensor cover 38 for allowing the user to adjust the sensitivity of vibration sensor 16. The manner in which such adjustments may be made will be described in greater detail below in conjunction with FIGS. 4–6.

Figure 4:
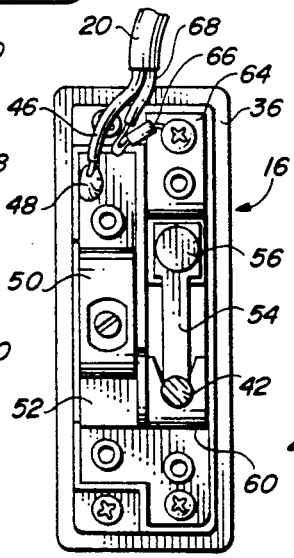
FIG. 4 is a top view of the vibration sensor with the outer cover removed.

FIG. 4 is a top view of vibration sensor 16 with protective cover 28 removed. Vibration sensor 16 may be of the type commercially available under the trademark "Safe House" from the Radio Shack division of Tandy Corporation of Fort Worth, Texas, under catalog number 49-521. A first conductor 46 from connector cable 20 is electrically connected to a first electrical terminal 48. Terminal 48 is in turn coupled to a resilient metal contact 50 which overlies yet another metal contact 52. When protective cover 38 (see FIG. 3) is secured to base 36 by retaining screw 40 (see FIG. 3), resilient finger 50 is forced against, and electrically contacts, terminal 52 to complete the circuit therebetween.

Figure 6:
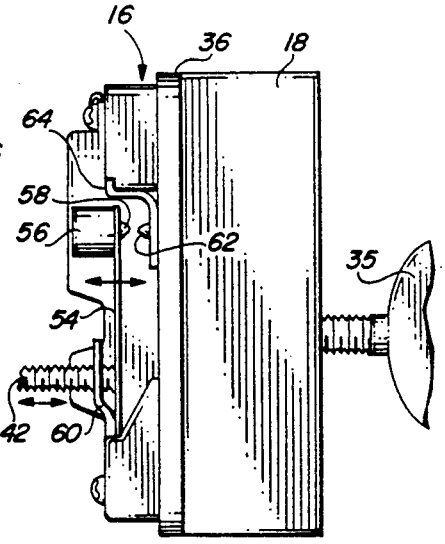

Referring now to FIGS. 4 and 6, vibration sensor 16 includes a thin resilient metal arm 54 electrically coupled to terminal 52. The free end of resilient arm 54 has a weight 56 secured to its upper surface and a contact 58 secured to its lower surface. When the base 36 of vibration detector 16 is vibrated, as by the impact of a bullet striking target board 12, resilient arm 54 is accelerated back and forth, as shown by the arrows in FIG. 6. Adjustment screw 42 threadedly engages a support 60, and the lower end of adjustment screw 42 contacts resilient arm 54, urging contact 58 toward a mating contact 62 electrically coupled to terminal 64, Terminal 64 is coupled by a 100K ohm resistor 66 to the second conductor 68 extending from connector cable 20.

In order to adjust the sensitivity of vibration sensor 16, the user begins by advancing adjustment screw 42 until contacts 58 and 60 just touch each other. Further advancing adjustment screw 42 into protective cover 38 (see FIG. 3) renders vibration sensor 16 less sensitive, as for larger, more powerful projectiles, or to avoid false triggering during windy conditions. In contrast, backing adjustment screw 42 out of protective cover 38 renders vibration sensor 16 more sensitive and allows it to detect impacts from smaller, less powerful projectiles. In either case, the normal condition for vibration sensor 16 is for contacts 58 and 62 to engage each other, creating a closed electrical circuit. When vibration sensor 16 is subjected to a sufficient impact, weight 56 and resilient arm 54 will be accelerated away from contact 62, thereby temporarily creating an open circuit which may be recognized by the controller circuitry, to be discussed below.

Figure 7:
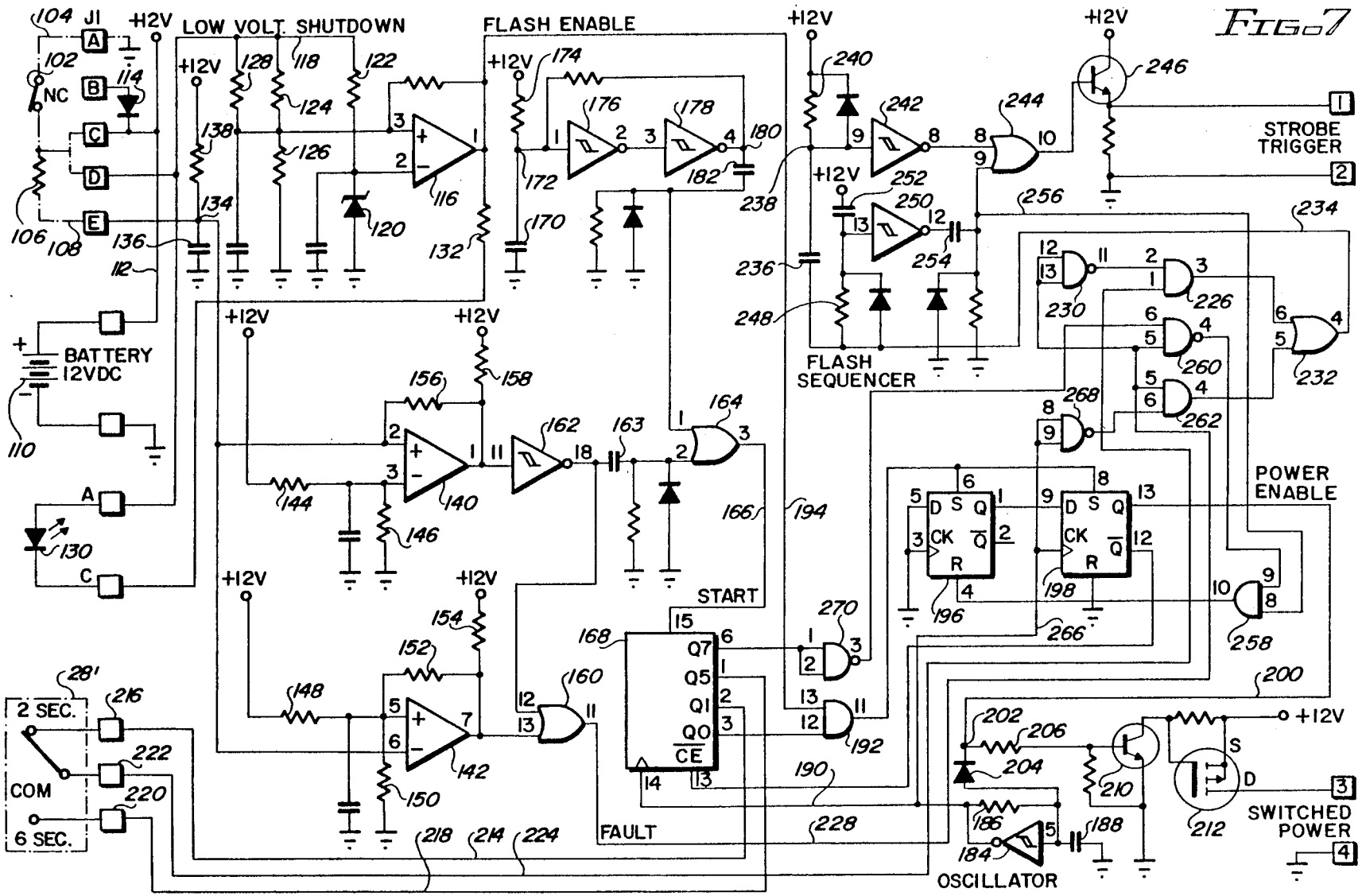
FIG. 7 is an electrical circuit schematic showing the controller circuitry coupled to the vibration sensor and serving to generate a trigger signal in response to a detected impact, and showing the driver circuitry used to operate the strobe flash tube in response to the generation of the trigger signal.

Referring to the electrical schematic shown in FIG. 7, vibration sensor 16 is indicated by normally closed switch 102. Conductor 46 of connector cable 20 (see FIG. 4) is represented by dashed conductor 104 in FIG. 7 and is coupled to terminal A of the controller circuit which, as shown, is connected to ground potential. Resistor 66 shown in FIG. 4 is designated by reference numeral 106 in FIG. 7, and conductor 68 of FIG. 4 is designated by reference numeral 108, coupled to terminal E of the controller circuit.

Also shown in FIG. 7 is the 12 volt D.C. storage battery 110, the negative terminal of which is coupled to ground potential, and the positive terminal of which is coupled to the twelve volt power supply line 112. Storage battery 110 is a rechargeable battery. During recharging, a source voltage greater than 12 volts is applied to terminal B of the controller circuit shown in FIG. 7 for passing a charging current through diode 114 into the positive terminal of storage battery 110.

The controller circuit shown in FIG. 7 includes a low voltage shut down circuit including comparator 116 (Part No. LM393). Voltage from the positive terminal of battery 110 is applied, through jumper terminals C and D, to conductor 118 of the low voltage shut down circuitry. A jumper is normally inserted across terminals C and D for such purpose. The inverting terminal (Pin 2) of comparator 116 is normally set at 5.1 volts by zener diode 120 (Part No. 1N751). Resistor 122 (10K ohms) is coupled between conductor 118 and zener diode 120 and supplies a biasing current thereto. The positive terminal (Pin 3) of comparator 116 normally receives a bias voltage of 5.7 volts generated by the voltage divider network formed by resistor 124 (75K ohms) and resistor 126 (68K ohms). If the voltage across battery 110 drops to 10.5 volts, then the divided voltage at the positive terminal of comparator 116 drops to 5.1 volts; this causes the output terminal (Pin 1) of comparator 116 to be pulled to a low voltage. The output terminal of comparator 116 is designated as "FLASH ENABLE" in FIG. 7. Accordingly, the "FLASH ENABLE" signal goes low when the battery voltage falls to 10.5 volts. Whenever the "FLASH ENABLE" signal is low, the strobe flash unit will not operate. Resistor 128 (1 Megohm) may be used as a fine adjust to accurately set the shut-off trip point. With the "FLASH ENABLE" signal at a low level, current flows from conductor 118 through light emitting diode 130, and through resistor 132 (1K ohms) for illuminating light emitting diode 130, corresponding to LED 30 shown in FIG. 2, to alert the user that storage battery 110 needs to be recharged.

The controller circuitry shown in FIG. 7 also includes a sensor trigger circuit responsive to the electrical impulse generated by vibration sensor 102 when an impact is detected. Terminal E of the controller circuit is coupled to node 134. A 22 microfarad capacitor 136 extends between node 134 and ground potential. A charging resistor 138 (100K ohms) extends between node 134 and the 12 volt power supply.

Node 134 is coupled to the inverting input terminal (Pin 2) of comparator 140 (Part No. LM33) and to the inverting input terminal (Pin 6) of comparator 142. Comparator 140 also includes a positive input terminal (Pin 3) which is normally biased at approximately 6.6 volts by a resistor divider network including resistor 144 (82K ohms) and resistor 146 (100K ohms). The positive terminal (Pin 5) of comparator 142 (Part No. LM33) is normally biased at approximately 5.5 volts. Resistor 148 (120K ohms) extends between the 12 volts power supply and the positive input terminal of comparator 142. Resistor 150 (100K ohms) extends between the positive input terminal of comparator 142 and ground potential. Feedback resistor 152 (1 Meg ohm) extends between the positive input terminal and the output terminal (Pin 7) of comparator 142. Resistor 154 extends between the positive terminal of comparator 142 and the power supply voltage. Similarly, in regard to comparator 140, feedback resistor 157 extends between the inverting input terminal of comparator 140 and the output terminal (Pin 1) thereof. Resistor 158 (10K ohms) extends between the power supply voltage and the output terminal of comparator 140. All of comparators 116, 140, and 142 may be of the type available under the desgination LM 393.

Node 134 is oridinarily at approximately 6.1 volts when the vibration sensor contacts are closed. Accordingly, comparator 140 is ordinarily biased so that its output is normally high, while comparator 142 is biased for causing its output to ordinarily be low.

It is an objective of the controller circuitry to detect not only an opening of the vibration sensor contacts, but also both an open and a short condition in the connector cable 20 (see FIG. 1) as might be caused by the impact from a bullet. If conductor 108 is shorted to ground, then node 134 will fall toward ground potential, and the output of comparator 142 will switch to a high level; accordingly, the output of OR gate 160 is also forced to a high level, representing a "FAULT" condition.

On the other hand, if conductor 108 or conductor 104 of connector cable 20 become open, as being severed by a bullet, the voltage at node 134 rises, and the output of comparator 140 goes low. The output of comparator 140 is coupled to the input of inverter 162 (Part No. 40106); accordingly, when the output of comparator 140 goes low, the output of inverter 162 goes high, causing the output of OR gate 160 (Part No. 4071) to go high and remain high as long as the open circuit condition remains, thereby setting the "FAULT" condition.

During normal operation, the detection of an impact by vibration sensor 102 temporarily causes the voltage at node 134 to rise, causing the output of comparator 140 to go low, and the output of inverter 162 to go high. The output of inverter 162 is coupled through a 0.1 microfarad capacitor 163 to a first input (Pin 2) of OR gate 164 (Part No. 4071). The positive pulse at the output of inverter 162 is coupled by capacitor 163 to the input terminal of OR gate 164 (Part No. 4071) for creating a positive-going "START" pulse. The "START" pulse is coupled by conductor 166 to the Reset input terminal (Pin 15) of a decade counter 168 (Part No. CD 4017). Counter 168 includes a series of output terminals Q0 (Pin 3), Q1 (Pin 2), Q5 (Pin 1), and Q7 (Pin 6). Each of these outputs signals is reset to a low level upon the receipt of the "START" pulse by counter 168.

The control circuit shown in FIG. 7 also includes a power-on reset circuit for clearing the logic circuit when the power supply voltage is first applied to the control circuitry. The power-on reset circuit allows the controller circuitry to operate properly on the first vibration sensor detection, and also permits the controller circuitry to check the connector cable condition whenever power is enabled. Capacitor 170 is a 22 microfarad capacitor coupled between ground potential and node 172. A pull up resistor 174 of 100K ohms extends between node 172 and the power supply voltage for charging capacitor 170 at initial power-up. As the voltage at node 172 rises, series-connected inverters 176 and 178 (Part Nos. 40106) shape a positive pulse at node 180 which is coupled by capacitor 182 (0.1 microfarad) to another input terminal (PIN 1) of OR gate 164, thereby generating an initial "START" pulse to reset counter 168.

The remainder of the circuitry shown in the schematic of FIG. 7 is used to determine the sequence and number of flashes which the flash strobe unit will output as determined by the type of event detected. There are generally two classes of events to consider, normal operation wherein the vibration sensor detects the impact of a projectile, and secondly, a "FAULT" mode wherein either a short or open in the connector cable is detected.

Assuming that the first type of event has occurred, namely, that a bullet has struck the target and caused the vibration sensor contacts to open temporarily, the sequences as follows. Inverter 184 (Part No. 40106) is configured as a one Hertz oscillator (i.e., one clock cycle per second). Feedback resistor 186 (1.3 Meg ohms), and timing capacitor 188 (0.1 microfarad) is coupled between the input of the inverter 184 and ground potential. The output of oscillator 184 is coupled by conductor 190 to the clock input (Pin 14) of decade counter 168. Decade counter 168 provides a delay period, which may be selected by the user, before triggering a flash following the event of a bullet striking the target board. As indicated above, immediately following detection of a bullet striking the target, a "START" pulse resets decade counter 168, causing output Q0 (Pin 3) to go to a high level and the remaining output terminals to go to a low level. Output Q0 of decade counter 168 is coupled to AND gate 192 (Part No. 4081). The second input (Pin 13) of AND gate 192 is coupled by conductor 194 to the previously described "FLASH ENABLE" signal generated at the output of comparator 116. Since both such signals are at a high level, the output terminal (Pin 11) of AND gate 192 assumes a high level, setting flip-flops 196 and 198 (Part Nos. 4013). Accordingly, the Q output (Pin 13) of flip-flop 198 is set to a high level, corresponding to the "POWER ENABLE" signal applied to conductor 200. The "POWER ENABLE" signal serves to switch power on to the strobe flash unit. Conductor 200 is coupled to node 202, and when "POWER ENABLE" is at a high level, diode 204 is biased off, permitting oscillator 184 to operate and clock the decade counter 168. When "POWER ENABLE" is at a high level, node 202 is at a high level and resistor 206 (3.0K ohms) provides bias current to transistor 210 (Part No. MPSA05), thereby enabling the gate terminal (G) of field effect transistor 212, and thereby coupling the 12 volt power supply to switched power terminal 3 for coupling to the strobe flash unit.

As indicated above, the "POWER ENABLE" signal enables oscillator 184 to provide a clock signal to decade counter 168 for allowing the decade counter to count up. It will be recalled that the user may select the period of delay as between two seconds and six seconds by operating a switch on the front face 24 of the strobe housing 22 (see FIG. 2). The delay selection switch 28 is represented in FIG. 7 by the dashed box labelled 28'. The Q1 output of decade counter 168 is coupled by conductor 214 to terminal 216 of selection switch 28'. Similarly, the Q5 output of decade counter 168 is coupled by conductor 218 to terminal 220 of selection switch 28'. The user may set selection switch 28' in either position. Assuming that the user has selected switch 28' to select a two second delay, as shown in FIG. 7, terminal 216 is coupled by selection switch 28' to terminal 222; in turn, terminal 222 is coupled by conductor 224 to an input terminal (Pin 1) of AND gate 226 (Part No. 4081). Thus, when either the Q1 output goes high (when the 2 second delay is selected), or the Q5 output goes high (when a 6 second delay is selected) the first input (Pin 1) of AND gate 226 goes to a high level. It will be recalled that the output terminal of OR gate 160 creates a "FAULT" signal which, when high, signals a problem with the connector cable. The "FAULT" signal is routed by conductor 228 to both input terminals (Pins 12 and 13) of NAND gate 230 (Part No. 4011), connected as an inverter. The inverting output terminal (Pin 11) of NAND gate 230 is coupled to the second input (Pin 2) of AND gate 226. Accordingly, so long as the "FAULT" signal is low and the selected decade counter output (Q1 or Q5) is high, the output of AND gate 226 will also be driven to a high level. The output terminal (Pin 3) of AND gate 226 is in turn coupled to a first input terminal (Pin 6) of OR gate 232 (Part No. 4071) forcing its output terminal (Pin 4) to a high level. Conductor 234 couples the output terminal of OR gate 232 to a flash sequencer circuit. The positive going pulse provided on conductor 234 is coupled by capacitor 236 (0.47 microfarad) to node 238. Node 238 is in turn coupled through resistor 240 (10K ohms) to the power supply voltage, and to the input terminal (Pin 9) of inverter gate 242 (Part No. 40106). The output terminal (Pin 8) of inverter gate 242 is in turn coupled to an input terminal (Pin 8) of OR gate 244 (Part No. 4071), the output terminal (Pin 10) of which is coupled to the base of transistor 246 (Part No. MPSA05). Transistor 246 is the trigger signal driver for the strobe flash unit; accordingly, when transistor 246 is enabled by the output of OR gate 244, a strobe trigger pulse is created across strobe trigger terminals 1 and 2 for triggering a flash from the strobe unit.

In the preferred embodiment, the strobe unit is flashed twice rapidly in succession to signal each hit of the target. The second of the two flashes is produced as follows. Conductor 234 is coupled by resistor 248 (680K ohms) to the input terminal (Pin 13) of inverter gate 250 (Part No. 40106). The input terminal of inverter gate 250 is also coupled by capacitor 252 (0.47 microfarads) to the positive supply voltage. When the output signal conducted by conductor 234 rises, the input terminal of inverter gate 250 charges toward a high level. Approximately 300 milliseconds after the first pulse created by inverter 242, the second invertor 250 creates a second pulse coupled by capacitor 254 (0.47 microfarads) to the second input terminal (Pin 9) of OR gate 244, thereby enabling transistor 246 a second time for triggering a second flash.

Conductor 256 couples the flash pulse produced by the output of inverter 250 to a first input terminal (Pin 8) of AND gate 258 (Part No. 4081). The second input (Pin 9) of AND gate 258 is normally high; accordingly, the output terminal (Pin 10) of AND gate 258 goes high, causing flip-flop 16 to be reset, thereby disabling oscillator 184, decade counter 168, and disabling the switched power terminals coupled to the strobe flash unit.

In the event that a FAULT condition exits, i.e., the connector cable 20 (see FIG. 1) is detected as being open or shorted, the "FAULT" signal on conductor 228 is at a high level. Accordingly, AND gate 226 is disabled. The "FAULT" conductor 228 is also coupled to the input terminals (Pin 5) of NAND gate 260 (Part No. 4011) and AND gate 262 (Part No. 4081). Accordingly, when decade counter 168 is reset by the "START" pulse on conductor 166, the Q0 output of decade counter 168 goes to a high level, setting flip-flops 196 and 198, thereby enabling the strobe switched power and oscillator 184 in the manner described above. The output of oscillator 184 is coupled by conductor 266 to both input terminals (Pins 8 and 9) of NAND gate 268 (Part No. 4011). The inverted clock signal produced at the output of NAND gate 268 is coupled to the second input terminal (Pin 6) of AND gate 262 and is thereby "ANDED" with the "FAULT" signal at the output terminal (Pin 4) thereof. The output signal at Pin 4 of AND gate 262 is passed by OR gate 232 to the flash sequencer circuitry for triggering the strobe in the manner explained above. However, instead of being triggered to produce one dual flash, the strobe is triggered to produce multiple dual flashes, one for each cycle of the clock. The number of dual flashes produced to signal a fault condition is at least three, and is preferably eight. When counter 168 counts up to 8, output Q7 of decade counter 168 is high, the output of inverter-connected NAND gate 270 (Part No. 4011) goes low, and the output of NAND gate 260 goes high. This permits the next trigger pulse to be "ANDED" to disable the oscillator and disable the power enable circuitry, thereby terminating the flash sequence.

Figure 8:
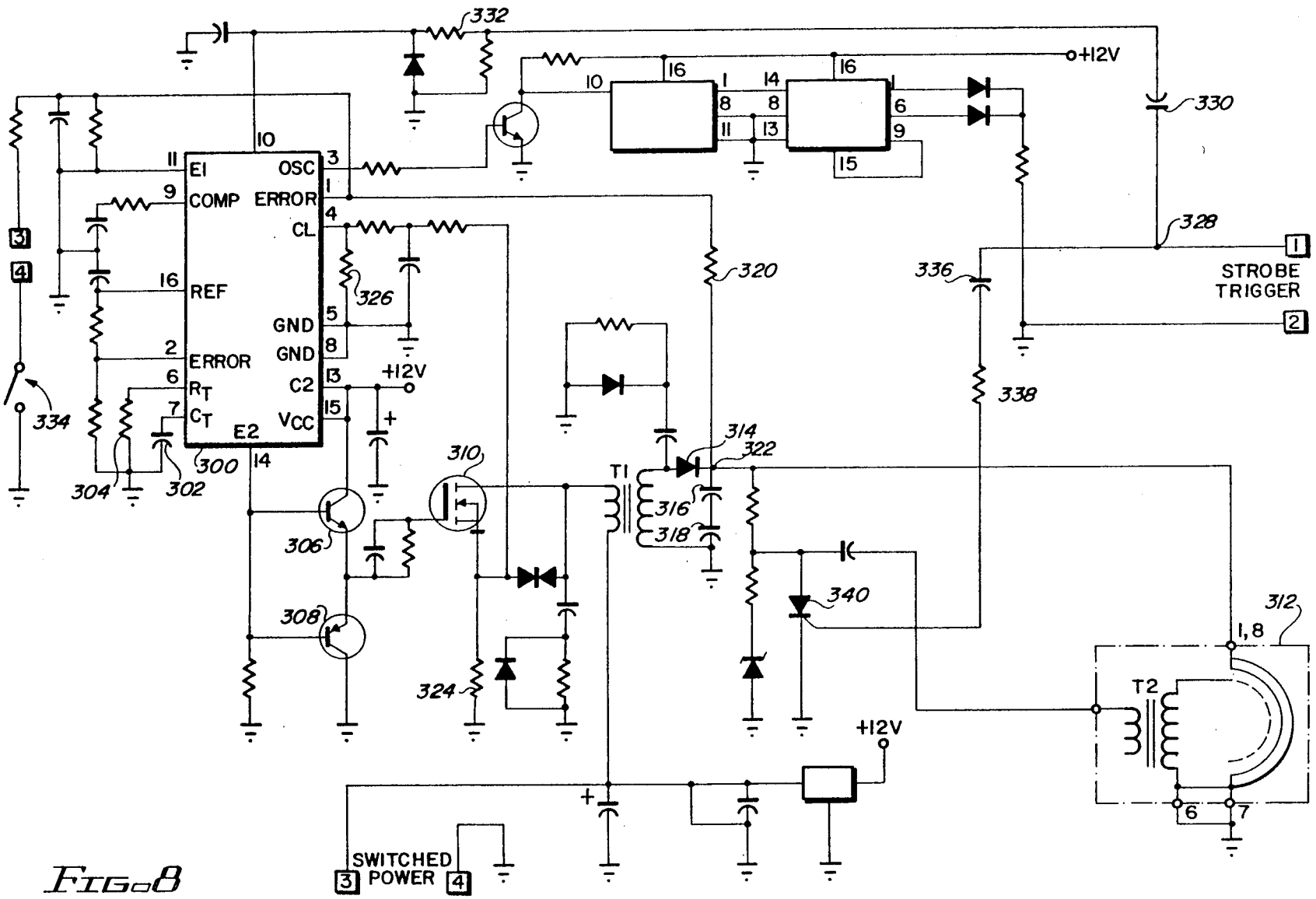
FIG. 8 is a circuit schematic illustrating the high-voltage power supply used to drive the xenon strobe flash tube.

Turning to FIG. 8, the electrical schematic for the high voltage strobe power supply is shown. This circuitry, with minor modifications, is that found within the xenon flash strobe commercially available from M-W Instruments, Inc. of Dallas, Texas under the designation of "Nova Strobe", Part No. NSB8001-001. The principal component of this high voltage power supply is a pulse width modulator integrated circuit 300 (Part No. SG3524B). This integrated circuit includes an oscillator, the base frequency of which is set by capacitor 302 (0.01 microfarads) and resistor 304 (3.16K ohms). The output driver of integrated circuit 300 (Pin 14) drives transistors 306 and 308 (MPSA05, and MPSA56, respectively), which in turn drive power field effect transistor 310 (Part No. RFP18N08). Power transistor 310 in turn drives step-up transformer T1 to increase the working voltage to a usable level for the xenon flash tube 312. Diode 314 rectifies the AC voltage produced across transformer T1 to provide a DC voltage. Capacitors 316 and 318 (290 microfarads each) are energy storage capacitors. Resistor 320 is used to feedback a sample of the resulting voltage to integrated circuit 300. This feedback voltage is sensed by integrated circuit 300 to regulate the voltage at node 322 to approximately 500 volts. Regulation of the output voltage is maintained by varying the width of the pulses which drive transformer T1. The wider the pulse applied to the transformer T1, the more power is transferred therethrough. Resistor 324 (0.3 ohms) is used to sense the current flow through power transistor Q3 and transformer T1. The very small voltage developed across resistor 324 is fed to Pin 4 of integrated circuit 300, the current limit (CL) input terminal. Resistor 326, coupled between Pin 4 of integrated circuit 300 and ground potential, is selected to adjust the maximum high voltage obtainable.

The strobe trigger pulse from the controller circuitry shown in FIG. 7 is connected to terminal block 1, and node 328, of the high voltage power supply shown in FIG. 8. This trigger pulse is fed through capacitor 330 (0.47 microfarads) and resistor 332 (10K ohms) to pin 10 of integrated circuit 300. Pin 10 is a shut down function to disable the switched power supply voltage applied at terminal blocks 3 and 4 from the correspondingly numbered blocks within FIG. 7, while the strobe is firing. Switch 334 is simply an external on/off switch for the high voltage strobe power supply.

Returning to node 328 in FIG. 8, the strobe trigger pulse is also coupled by capacitor 336 (0.01 microfarads) and resistor 338 (150 ohms) to turn on SCR 340 (Part No. 218409). SCR 340 permits the strobe to flash, discharging the energy stored across storage capacitors 316 and 318.

Those skilled in the art will now appreciate that a ballistic impact indicator has been described which generates a delayed strobe flash signal for indicating to a marksman whether he or she has hit the target. The described ballistic impact indicator also serves to alert the user if the vibration sensor or connector cable are damaged by the impact from a bullet. The ballistic impact indicator permits the user to readily adjust the sensitivity of the unit, and provides a highly portable, easy to use impact indicator which may be used in the field, if desired. The ballistic impact indicator includes a vibration sensor which is readily attached to a variety of target boards.

While the present invention has been described with reference to a preferred embodiment thereof, the description is for illustrative purposes only and should not be construed to limit the scope of the invention. Various modifications and changes may be made by those skilled in the art without departing from the true spirit and scope of the invention as defined by the appended claims.

What is claimed is;

1. A ballistic impact indicator for alerting a marksman that a bullet fired by the marksman has hit a desired target, said ballistic impact indicator comprising in combination:

a. a vibration sensor adapted to produce an electrical impulse when a bullet strikes the target;

b. attachment means for attaching said vibration sensor to the target;

c. control circuit means having an input electrically coupled with said vibration sensor and responsive to the electrical impulse produced by said vibration sensor for generating a delayed trigger signal in response thereto;

d. light means electrically coupled to said control circuit means and responsive to said delayed trigger signal for transmitting a light signal to the marksman indicating that the target was hit, said light means including a strobe flash unit for transmitting an intense focused flash of light of short duration visible at a distance day or night, said strobe flash unit being disposed proximate the target, and said focused flash of light being visible a relatively great distance from the target ; and e. power supply means coupled to said control circuit means and to said light means for providing electrical power thereto;

f. said control circuit means and said light means delaying operation of said light signal after the bullet strikes the target for allowing the marksman to recover from any recoil produced by the firing of the bullet and to refocus upon the target before operating said light means and before transmitting said light signal.

2. A ballistic impact indicator as recited by claim 1 wherein said attachment means removably attaches said vibration sensor to the target.

3. A ballistic impact indicator as recited by claim 2 wherein said attachment means includes an adjustable clamp for engaging an edge of the target, said vibration sensor being mounted to said adjustable clamp.

4. A ballistic impact indicator as recited by claim 1 wherein said control circuit generates said delayed trigger signal at least one second after said vibration sensor produces said electrical impulse for allowing the marksman to recover from any recoil produced by the firing of the bullet and to refocus upon the target before operationg said light means.

5. A ballistic impact indicator as recited by claim 1 wherein said strobe flash unit includes a xenon flash tube.

6. A ballistic impact indicator as recited by claim 1 wherein said power supply means includes a rechargeable storage battery for allowing said ballistic impact indicator to be portable and to be placed in the field.

7. A ballistic impact indicator as recited by claim 6 wherein said control circuit means includes a low voltage indicator to indicate that the storage battery needs to be recharged.

8. A ballilstic impact indicator for alerting a marksman that a bullet fired by the marksman has hit a desired target, said ballistic impact indicator comprising in combination:

a. a vibration sensor adapted to produce an electrical impulse when a bullet strikes the target, wherein said vibration sensor is adjustable to allow the marksman to adjust the sensitivity of said ballistic impact indicator in accordance with the energy of the bullet and prevailing wind conditions;

b. attachment means for attaching said vibration sensor to the target;

c. control circuit means having an input electrically coupled with said vibration sensor and responsive to the electrical impulse produced by said vibration sensor for generating a delayed trigger signal in response thereto;

d. light means electrically coupled to said control circuit means and responsive to said delayed trigger signal for transmitting a light signal to the marksman indicating that the target was hit; and e. power supply means coupled to said control circuit means and to said light means for providing electrical power thereto.

9. A ballistic impact indicator for alerting a marksman that a bullet fired by the marksman has hit a desired target, said ballistic impact indicator comprising in combination:

a. a vibration sensor adapted to produce an electrical impulse when a bullet strikes the target;

b. attachment means for attaching said vibration sensor to the target;

c. control circuit means having an input electrically coupled with said vibration sensor and responsive to the electrical impulse produced by said vibration sensor for generating a delayed trigger signal in response thereto, said control circuit means generating said delayed trigger signal at least one second after said vibration sensor produces said electrical impulse for allowing the marksman to recover from any recoil produced by the firing of the bullet and to refocus upon the target before operating said light means, said control circuit means including switch means having at least two differenc operative positions, said switch means being operable by the marksman to select between a first delay period and a second delay period to vary the delay between the production of the electrical impulse and the generation of the delayed trigger signal;

d. light means electrically coupled to said control circuit means and responsive to said delayed trigger signal for transmitting a light signal to the marksman indicating that the target was hit; and e. power supply means coupled to said control circuit means and to said light means for providing electrical power thereto.

10. A ballistic impact indicator for alerting a marksman that a bullet fired by the marksman has hit a desired target, said ballistic impact indicator comprising in combination:

a. a vibration sensor adapted to produce an electrical impulse when a bullet strikes the target ;

b. attachment means for attaching said vibration sensor to the target;

c. control circuit means having an input electrically coupled with said vibration sensor and responsive to the electrical impulse produced by said vibration sensor for generating a delayed trigger signal in response thereto;

d. an electrical cable coupling said vibration sensor to said control circuit means;

e. light means electrically coupled to said control circuit means and responsive to said delayed trigger signal for transmitting a light signal to the marksman indicating that the target was hit; and f. power supply means coupled to said control circuit means and to said light means for providing electrical power thereto;

g. said control circuit means detecting damage to either said vibration sensor or said electrical cable caused by direct impact by a bullet, said control circuit means causing said light means to flash at least three times in succession to warn the marksman of damage to said vibration sensor or said electrical cable.

11. A ballistic impact indicator for alerting a marksman that a bullet fired by the marksman has hit a desired target, said ballistic impact indicator comprising in combination:

a. a vibration sensor adapted to produce an electrical impulse when a bullet strikes the target ;

b. attachment means for attaching said vibration sensor to the target;

c. control circuit means having an input electrically coupled with said vibration sensor and responsive to the electrical impulse produced by said vibration sensor for generating a trigger signal in response thereto;

d. light means electrically coupled to said control circuit means and responsibe to said trigger signal for transmitting a light signal to the marksman indicating that the target was hit;

e. power supply means coupled to said control circuit means and to said light means for providing electrical power thereto;

f. an electrical cable coupling said vibration sensor to said control circuit means; and g. said control circuit means detecting damage to either said vibration sensor or said electrical cable caused by direct impact by a bullet, said control circuit means causing said light means to flash at least three times in succession to warn the marksman of damage to said vibration sensor or said electrical cable.

12. A ballistic impact indicator as recited by claim 11 wherein said attachment means removably attaches said vibration sensor to the target.

13. A ballistic impact indicator as recited by claim 12 wherein said attachment means includes an adjustable clamp for engaging an edge of the target, said vibration sensor being mounted to said adjustable clamp.

14. A ballistic impact indicator as recited by claim 11 wherein said vibration sensor is adjustable to allow the marksman to adjust the sensitivity of said ballistic impact indicator in accordance with the energy of the bullet and prevailing wind conditions.

15. A ballistic impact indicator as recited by claim 11 wherein said light means includes a strobe flash unit for transmitting an intense focused flash of light of short duration visible at a distance day or night.

16. A ballistic impact indicator as recited by claim 15 wherein said strobe flash unit includes a xenon flash tube.

17. A ballistic impact indicator as recited by claim 11 wherein said power supply means includes a rechargeable storage battery for allowing said ballistic impact indicator to be portable and to be placed in the field.

18. A ballistic impact indicator as recited by claim 17 wherein said control circuit means includes a low voltage indicator to indicate that the storage battery needs to be recharged.

* * * * *